US010721563B2

(12) United States Patent
Grimm et al.

(10) Patent No.: US 10,721,563 B2
(45) Date of Patent: Jul. 21, 2020

(54) METHOD AND APPARATUS FOR PROCESSING AUDIO SIGNALS

(71) Applicant: Sennheiser electronic GmbH & Co. KG, Wedemark (DE)

(72) Inventors: Alexander Grimm, Wunstorf (DE); Markus Wolff, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 16/548,964

(22) Filed: Aug. 23, 2019

(65) Prior Publication Data

US 2020/0077189 A1 Mar. 5, 2020

(30) Foreign Application Priority Data

Aug. 31, 2018 (DE) ..... 10 2018 121 309

(51) Int. Cl.

| | |
|---|---|
| ***H04R 3/04*** | (2006.01) |
| ***H04R 29/00*** | (2006.01) |
| ***G10L 25/21*** | (2013.01) |

(52) U.S. Cl.

CPC ..... *H04R 3/04* (2013.01); *G10L 25/21* (2013.01); *H04R 29/001* (2013.01)

(58) Field of Classification Search

CPC .... H04R 3/04; H04R 2430/03; H04R 1/2811; H04R 1/2819; H04R 3/002; H04R 1/22;

(Continued)

(56) References Cited

U.S. PATENT DOCUMENTS

| | | | | |
|---|---|---|---|---|
| 7,715,573 | B1 * | 5/2010 | Yonemoto | H04S 1/002 333/14 |
| 8,094,835 | B2 * | 1/2012 | Shimura | H03G 5/16 381/101 |

(Continued)

FOREIGN PATENT DOCUMENTS

| | | |
|---|---|---|
| DE | 697 16 216 | 7/2003 |
| WO | WO 97/42789 | 11/1997 |

OTHER PUBLICATIONS

Aarts, Ronald M. [et al]: Improving perceived bass and reconstruction of high frequencies for band limited signals. In: IEEE: Benelux Workshop on Model based Processing and Coding of Audio (MPCA-2002), Leuven, Belgium, Nov. 15, 2002, 2002, p. 59-71.

*Primary Examiner* — Lun-See Lao

(74) *Attorney, Agent, or Firm* — Haug Partners LLP

(57) ABSTRACT

Loudspeaker systems, which for technical reasons are not suitable for emitting strong bass signals, can use so-called virtual bass systems. Therein, low frequencies are replaced by their harmonics. However, virtual bass cannot always adequately replace real bass, such that tonal discrepancies may result. Methods and systems are disclosed to improve the bass reproduction of virtual bass by mixing the generated harmonics with a reduced original bass component of the input audio signal. The mixing ratio of this blend can be variable and can be determined automatically. For example, the mixing ratio can change when a level threshold is exceeded, when a temperature rises above/drops below a threshold, a calorimetric threshold is exceeded, or at fixed times of day.

15 Claims, 3 Drawing Sheets

State of the art

(58) Field of Classification Search
CPC .. H04R 1/323; H04R 2430/01; H04R 29/001; H04R 5/04; G10L 25/21; H04S 3/00
USPC ..... 381/54–59, 98, 1, 104, 106, 17–23, 119, 381/123, 99, 94.4–94.9; 84/1, 600, 723, 84/725, 726, 728
See application file for complete search history.

(56) References Cited

U.S. PATENT DOCUMENTS

| | | | | |
|---|---|---|---|---|
| 8,150,050 | B2 * | 4/2012 | Lee | H04R 3/04 381/103 |
| 8,229,135 | B2 * | 7/2012 | Sun | G10L 21/038 381/103 |
| 10,382,857 | B1 * | 8/2019 | Khanal | H04R 3/04 |
| 2014/0341394 | A1 * | 11/2014 | Croft, III | H04R 1/2811 381/102 |

* cited by examiner

METHOD AND APPARATUS FOR PROCESSING AUDIO SIGNALS

FIELD OF THE INVENTION

The invention relates to a method for processing audio signals as well as to an apparatus for processing audio signals.

BACKGROUND

Typically, large loudspeakers are used to reproduce low frequencies. Many small loudspeaker systems, which for technical reasons are not suitable for emitting strong bass signals, use so-called virtual bass systems. Therein, low frequencies are replaced by their harmonics. Due to a psycho-acoustic phenomenon, the loss of the fundamental frequency is not perceived in this scenario. Known in the prior art is, for example, the audio signal processing device for improving psycho-acoustic bass perception from "Improving Perceived Bass and Reconstruction of High Frequencies for Band Limited Signals", by R. M. Aarts, E. Larsen and D. Schobben (MPCA-2002), which is shown in FIG. 1. Therein, left and right input signals EL and ER are filtered in high-pass filters HFILL and HFILR, respectively. Furthermore, the input signals are summed and then filtered with a low-pass filter FIL1 to obtain the bass component. This bass component then is used to extract harmonics in a non-linear circuit NLD. These harmonics then pass through another filter FIL2 to obtain a suitable spectrum, and subsequently pass through an amplifier G, before they are added to the output signals of the high-pass filters HFILL and HFILR. The output signals AL and AR now no longer contain the low frequencies of which harmonics were generated. These were replaced by the so-called "synthetic" or "virtual" bass, i.e. the harmonics.

WO97/042789 shows various options, in which a level of a portion of the bass signals is detected and the generated harmonics are scaled according to this level. Thus, various non-linear circuits can be used to generate harmonics. In one version, the bass signal is split up into different frequency ranges by means of first band-pass filters BPF1A, . . . , BPF1N, as shown in FIG. 2. Subsequently, harmonics are generated for each of these frequency ranges via a non-linear circuit HGSA, . . . , HGSN, and said harmonics are scaled depending on their levels. The scaled harmonics then pass through a second band-pass filter BPF2A, . . . , BPF2N and finally are added AD to the high-pass filtered HPF input signal 10H. The output signal particularly is used for loudspeakers with high-pass characteristics, which cannot reproduce the original bass signal. Instead, its harmonics are reproduced to give the listener the impression of a bass component within the overall signal.

However, virtual bass cannot always adequately replace real bass. Significant tonal discrepancies may occur between the bass systems in certain frequency ranges.

Another technology uses level limiters, which generally are used in active loudspeakers. Therein, the level of an audio signal is limited to a certain maximum depending on frequency. However, limiting levels dynamically changes the tonality of the audio signal.

In the German patent application establishing priority, the German Patent and Trademark Office has researched the following documents: DE 697 16 216 T2 and AARTS, Ronald M. [et al]: Improving perceived bass and reconstruction of high frequencies for band limited signals. In: IEEE: Benelux Workshop on Model based Processing and Coding of Audio (MPCA-2002), Leuven, Belgium, Nov. 15, 2002, 2002, pg. 59-71.

SUMMARY OF THE INVENTION

One object of the present invention is to improve the bass reproduction via the use of virtual bass. The inventors have recognized that it is advantageous to make the bass reproduction flexible. For example, it could be desirable in certain circumstances to operate a device for audio reproduction, which is suitable for reproducing low frequencies, in such a manner that the output of low frequencies is suppressed. In this case, the reproduced audio signal is improved by replacing the suppressed low frequencies with virtual bass. Such circumstances may result from the operational situation or from technical requirements, such as when consideration must be given to not disturbing neighbours at night or to preventing overloading the power amplifier or overheating the loudspeakers. The system still is able to reproduce the complete input audio signal in other circumstances. The invention therefore is based on the realisation that, depending on the specific application, it may be appropriate to mix the generated harmonics with the original bass component of the input audio signal, wherein the mixing ratio can be adjusted to suit the specific application in one embodiment. In other words, it is not necessary to completely switch back and forth between the two operating modes "original bass" and "synthetic bass". Instead, according to the invention, the degree of blending can be regulated to give the user an optimal listening experience while shifting the overall thermal balance, the maximum level of power amplifier or loudspeaker and/or the "disturbing" level of low-frequencies of the device into a non-critical range.

A method for processing the audio of an input audio signal, in one exemplary embodiment of the invention, comprises generating harmonics of a bass component of the input audio signal, generating a reduced-bass input audio signal from the input audio signal by reducing the amplitude of that bass component for which the harmonics were generated to a residual bass amplitude; and adding the generated harmonics to the reduced-bass input audio signal, whereby an output signal having an output bass component is created. The method includes three operating modes, wherein in a first operating mode, no generated harmonics are contained in the output signal and the output bass component is equivalent to the bass component of the input audio signal; in a second operating mode, the generated harmonics are contained in the output signal with a maximum harmonics amplitude and the bass component of the input audio signal is only contained in the output signal with a residual bass amplitude: and in a third operating mode, a blend of generated harmonics and the bass component of the input audio signal is contained in the output signal, wherein the output bass component has an amplitude which is lower than that in the first operating mode and higher than that in the second operating mode, and wherein the generated harmonics in the output signal have an amplitude which is higher than those in the first operating mode and lower than those in the second operating mode.

A corresponding apparatus is disclosed. Additionally, a soundbar or a subwoofer having a device according to the invention is also disclosed. A soundbar is an elongated loudspeaker box, which contains a plurality of loudspeakers and an electronic signal processing unit to imitate spatial sound by means of acoustic and electronic effects. A subwoofer is a special loudspeaker box which is optimised to reproduce low-frequency audio signals.

BRIEF DESCRIPTION OF THE DRAWINGS

Further details and advantageous embodiments are shown in the drawings. Therein

DETAILED DESCRIPTION OF THE INVENTION

Figure 1:
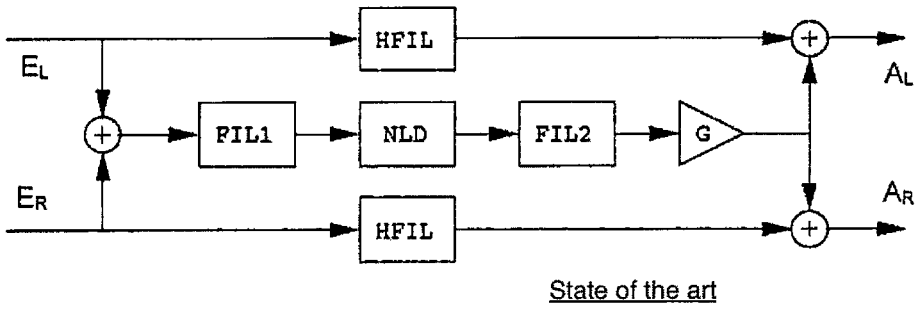
FIG. 1 shows a block diagram of a known audio signal processing device for improving psycho-acoustic bass perception.
Figure 2:
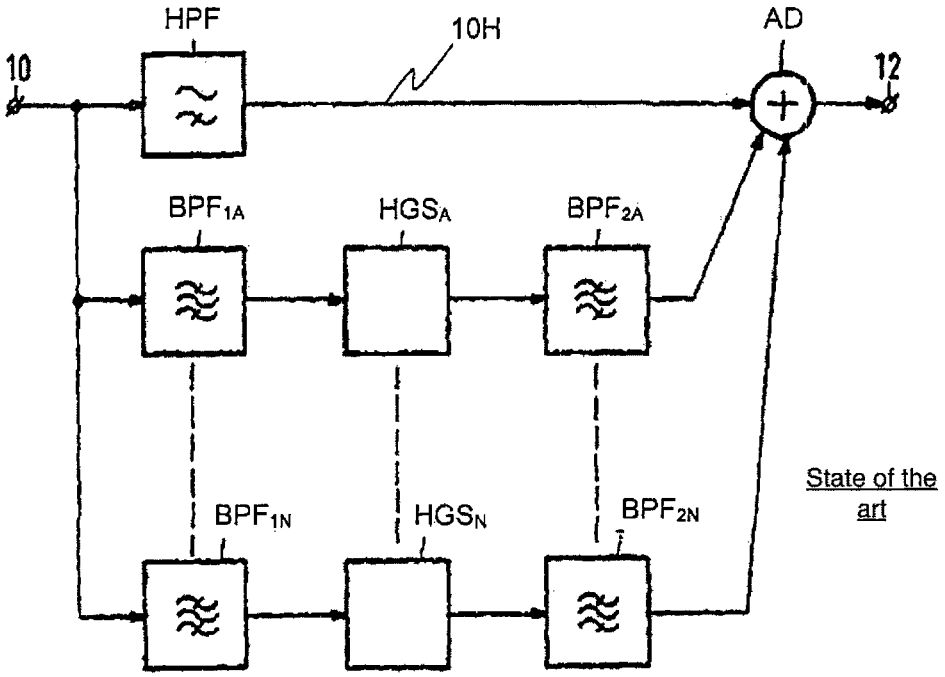
FIG. 2 shows a block diagram of another known audio signal processing device for improving psycho-acoustic bass perception.
Figure 3:
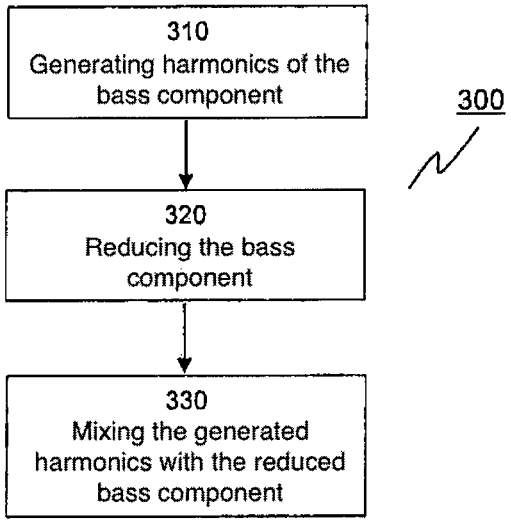
FIG. 3 shows a flow chart of a method according to the invention.

FIG. 3 shows a flow chart of a method 300 according to the invention for processing the audio of an input audio signal. It contains the steps Generating 310 harmonics of a bass component of the input audio signal, Generating a reduced-bass input audio signal from the input audio signal by Reducing 320 the level of that bass component for which the harmonics are generated, and Mixing 330 the generated harmonics with the reduced-bass input audio signal, wherein an output audio signal is created. There are three operating modes in this context, which basically differ in the mixing ratio during Mixing 330: in a first operating mode, the output signal contains the complete bass component of the input audio signal and the output signal contains practically no generated harmonics. In this operating mode, the output bass component may be equivalent to the input bass component, which means that the output signal corresponds entirely to the input signal. In a second operating mode, the generated harmonics are contained in the output signal at a maximum amplitude, while the bass component of the input audio signal is more or less entirely removed from the output signal; only a residual portion in the form of a residual bass amplitude remains. This residual portion could represent between 0% and 5%, for example, of the amplitude of the bass component of the input audio signal. In other words, the bass component of the input audio signal essentially is replaced by the generated harmonics of the virtual bass. In a third operating mode, a blend of the generated harmonics and the bass component of the input audio signal is contained in the output signal. The exact mixing ratio of this blend depends on the respective application; in typical applications, the proportion of both the generated harmonics and the bass component of the input audio signal is significantly higher than 0% and significantly lower than 100%, such as 20:80 or 60:40 percent. The mixing can be conducted by scaling the levels or amplitudes of the generated harmonics and the bass component of the input audio signal (differently), and then layering them. The percentage share can relate to the volume, the sound pressure level, the signal energy or the signal level, for example.

Figure 4:
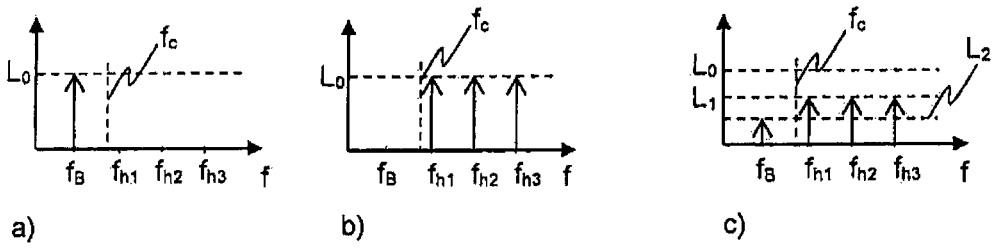
FIG. 4 shows frequencies in various operating modes.

FIG. 4 shows the principle of the various operating modes as a frequency diagram. In FIG. 4 *a*), the bass component of the input audio signal is shown as a single frequency $f_B$ with the amplitude or level $L_0$ as an illustration. However, the processing shown there for a single frequency $f_B$ is actually used for an entire frequency band in the invention. The frequency range up to a cut-off frequency $f_C$ is considered to be the bass component. Portions of the input audio signal with higher frequencies are not shown. According to the first operating mode, the harmonics $f_{h1}$, $f_{h2}$ and $f_{h3}$ are not mixed with the single frequency $f_B$ as a base frequency. Any harmonics of the base frequency that are inherently contained in the signal are not shown. Only harmonics above the cut-off frequency $f_C$ are mixed in. In FIG. 4 *b*), according to the second operating mode, the bass component of the input audio signal is completely filtered out and replaced by synthetic bass. For example, the base frequency $f_B$ has a level or amplitude of zero (0%) and its blended harmonics at the frequencies $f_{h1}$, $f_{h2}$ and $f_{h3}$ are at their respective full amplitudes (100%). This representation is idealized insofar as real high-pass filters let a residual signal pass, which here is referred to as residual bass and which has a residual bass amplitude which may be greater than zero. FIG. 4 *c*) shows the mixing according to the invention according to the third operating mode. Therein, the generated harmonics and the bass component of the input audio signal are individually scaled and mixed. The mixing can be conducted by overlaying. For example, the base frequency $f_B$ is reduced to the amplitude $L_2$, and the harmonics fh1, $f_{h2}$ and $f_{h3}$ are reduced to the amplitude $L_1$; both amplitudes are below the amplitude $L_0$ of the base frequency of the input audio signal. In other words, in the third operating mode, the output bass component has an amplitude which is lower than the one it has in the first operating mode and higher than the one it has in the second operating mode, and the generated harmonics in the output signal have an amplitude which is higher than the one they have in the first operating mode and lower than the one they have in the second operating mode. It must be considered that the amplitudes of the various harmonics can be fundamentally different from each other and from the original amplitude $L_0$ of the basic frequency, although all harmonics are represented with the same amplitude $L_0$ in FIG. 4 *b*).

In one embodiment, the mixing is conducted in such a manner that the total power of the reduced bass component and the generated harmonics essentially remains constant, i.e. the power lost by reducing the bass component 320 is fed back in via the generated harmonics. However, in other embodiments, this total power could be reduced or increased or could be adjustable.

The mixing ratio of the blend can be variable. It can be determined automatically or can be predefined. When reducing the amplitude of the bass component of the input audio signal, the amplitude is reduced according to the mixing ratio, and the amplitude of the added harmonics also is adjusted according to the mixing ratio. Therein, the amplitude of the added harmonics increases in direct proportion to the degree to which the amplitude of the bass component is reduced. Thus, in FIG. 4 *c*), changing the mixing ratio results in an increase of the amplitude $L_1$ of the harmonics and a corresponding decrease of the amplitude $L_2$ of the base frequency $f_B$, for example. Likewise, the amplitude $L_1$ of the harmonics can be reduced and the amplitude $L_2$ of the base frequency $f_B$ can be increased correspondingly.

The mixing ratio can be determined automatically. In one embodiment, said ratio is determined automatically on the basis of one or a plurality of measured parameters. Furthermore, the mixing ratio can be variable with respect to time. The parameter or parameters can be obtained by a time detection, for example, time of day or duration, a temperature measurement, or a measurement of the power of an input audio signal (or of another audio signal). Furthermore, an operating mode selector switch can be provided, such that a user can select or modify a desired operating mode. Possible operating modes are "original bass", "synthetic bass" and "automatic switching", for example. For example, the switching between operating modes in the automatic operating mode can be triggered by exceeding a threshold level, exceeding or falling below a temperature threshold, exceeding a calorimetric threshold or by control based defined times of day (e.g. real bass is increasingly replaced with virtual bass starting at 9 p.m. so as not to disturb the neighbours), and also by their combinations (e.g. starting at 10 p.m. and from 80 dB upwards, real bass increasingly is replaced with virtual bass).

Furthermore, the upper cut-off frequency $f_c$, and thus the bandwidth of the bass component, can be variable. For example, the virtual bass could replace frequencies below 30 Hz up to a certain time of day, after which time it also replaces higher frequencies, e.g. below 70 Hz. In another example, the virtual bass usually replaces frequencies below 40 Hz, wherein this limit gradually increases to 150 Hz as the temperature of the amplifier and/or the loudspeaker increases. This parameter is particularly useful if a loudspeaker is not capable of reproducing low frequencies and transforms the same into reactive power. By reducing low-frequency signal components, the signal energy can be reduced without audible effects when necessary.

In one embodiment, the mixing ratio is determined automatically based on a combination of a time of day, a power level of at least the bass component of the input audio signal, and the position of an operating mode selector switch. In one embodiment, the power of at least the bass component of the input audio signal is measured and the result is used to estimate a temperature of an apparatus according to the invention, of an amplifier or of a loudspeaker, wherein the estimated temperature is used as a parameter in the determination of the mixing ratio. The power measurement can result in the ratio of the areas deviating from a "desired characteristic curve" below and in between the frequency responses.

In one particularly advantageous embodiment, the mixing ratio can essentially assume infinitely variable values between a defined minimum and a defined maximum, e.g. between 0% and 100% or between 10% and 90%.

In one embodiment, the invention relates to an apparatus for processing the audio of an input audio signal. It contains a harmonics generator for generating harmonics of a bass component of the input audio signal, a bass level controller for generating a reduced-bass input audio signal by reducing the amplitude of that bass component of the input audio signal for which the harmonics are generated, and a signal-combining block for adding the generated harmonics to the reduced-bass input audio signal, whereby an output signal is created. The bass component of the output signal is referred to as an output bass component. Furthermore, the apparatus contains a control unit for controlling the signal-combining block, wherein the signal-combining block has at least three operating modes, of which one is selected by a control unit. In a first operating mode, no generated harmonics are contained in the output signal and the bass component of the input audio signal is contained entirely within the output signal, such that the output bass component is equivalent to the bass component of the input audio signal. In a second operating mode, the generated harmonics are contained within the output signal with a defined maximum harmonics amplitude and the bass component of the input audio signal is only contained within the output signal with a residual bass amplitude. In a third operating mode, a blend of the generated harmonics and the bass component of the input audio signal is contained in the output signal, wherein the mixing ratio can be pre-defined or variable. Specifically, in the third operating mode, the output bass component has an amplitude which is lower than the one it has in the first operating mode and higher than the one it has in the second operating mode, and the generated harmonics in the output signal have an amplitude which is higher than the one they have in the first operating mode and lower than the one they have in the second operating mode.

Figure 5:
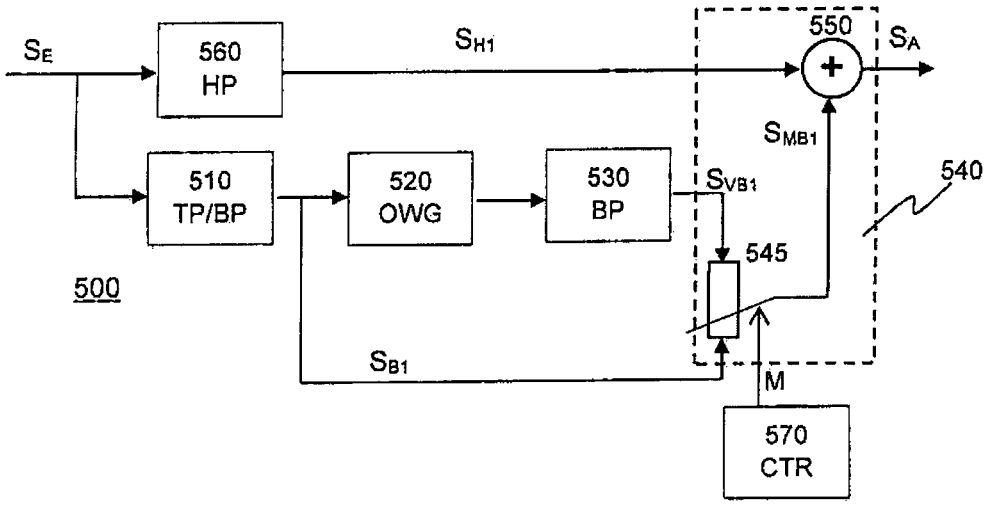
FIG. 5 shows a block diagram of an audio signal processing device according to the invention in a first embodiment.

FIG. 5 shows such an apparatus according to the invention in its first embodiment. An input audio signal $S_E$ passes through a first filter 560, which provides a reduced-bass input audio signal $S_{H1}$, and a second filter 510, which provides the bass component $S_{B1}$ of the input audio signal. The first filter 560 can be a high-pass and the second filter 510 can be a low-pass or band-pass, wherein the lower cut-off frequency of the band-pass is set such that essentially only an equivalent of the component of the input audio signal $S_E$ is filtered out. Furthermore, the lower cut-off frequency of the first filter 560 is identical to the upper cut-off frequency of the second filter 510, such that exactly the bass component $S_{B1}$ of the input audio signal is missing from the reduced-bass input audio signal $S_{H1}$. This bass component $S_{B1}$ of the input audio signal is fed into both a harmonics generator 520 and into a mixer 545. The harmonics generator 520 generates harmonics of the bass component $S_{B1}$ and feeds these into a third filter 530 for bandwidth limiting. This latter filter is a band-pass filter which filters the base frequency below its lower cut-off frequency and undesired harmonics above its upper cut-off frequency, and which provides the virtual bass signal $S_{VB1}$ at its output. A signal-combining block 540 now blends the bass component $S_{B1}$ of the input audio signal with the virtual bass signal $S_{VB1}$ in the mixer 545 according to a mixing ratio M defined by the control block 570 to obtain a resulting bass signal $S_{MB1}$. This resulting bass signal $S_{MB1}$ is layered over the reduced-bass input audio signal $S_{H1}$ in an overlaying block 550, e.g. a summing amplifier. Thereby, the output signal $S_A$ is created, in which signal the original bass component $S_{B1}$ and the virtual bass component $S_{VB1}$ are blended according to the mixing ratio.

The control block 570, which controls the mixing ratio M, can be a fixed setting (e.g. 50% each) in a simple version, or can be a manual controller. For the aforementioned three operating modes, mixing ratios can be selected according to the following table, for example.

TABLE 1

Mixing ratio according to operating modes

| Operating mode | Proportion of original bass ($S_{B1}$) | Proportion of synthetic bass ($S_{VB1}$) |
|---|---|---|
| 1. Operating mode ("original") | 100% | 0% |
| 2. Operating mode ("synthetic") | 0% | 100% |
| 3. Operating mode ("mixed") | 50% | 50% |

It must be remembered in this context that the mixing ratios do not necessarily apply at the signal slopes, i.e. in the area near the cut-off frequency $f_C$, of the filter 510, 560, but only in frequency ranges sufficiently removed from these (i.e. away from the slopes).

Figure 6:
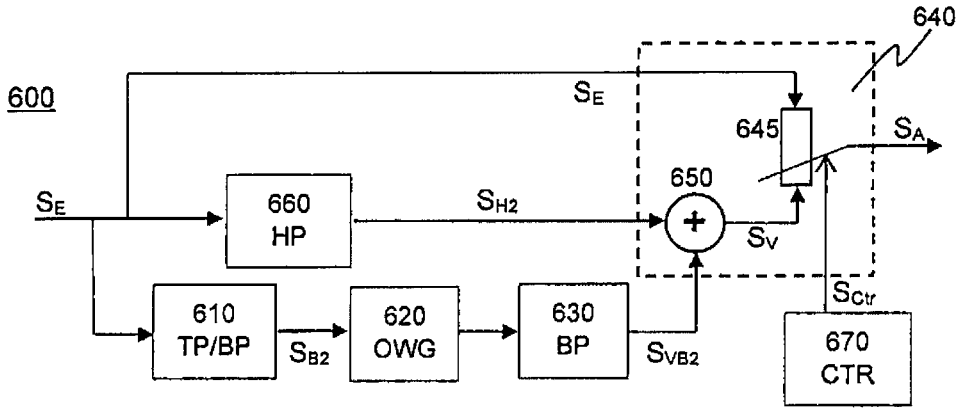
FIG. 6 shows a block diagram of an audio signal processing device according to the invention in a second embodiment.

FIG. 6 shows an apparatus 600 according to the invention in a second embodiment. The input audio signal $S_E$ again passes through a first (high-pass) filter 660, which provides a reduced-bass input audio signal $S_{H2}$, and a second (low-pass or band-pass) filter 610, which provides the bass component $S_{B2}$ of the input audio signal. This bass component $S_{B2}$ of the input audio signal is fed into the harmonics generator 620, which generates harmonics of the bass component $S_{B2}$ and feeds these into the third (band-pass) filter 630 for bandwidth limiting, which filter outputs the virtual bass signal $S_{VB2}$. The virtual bass signal $S_{VB2}$ is then layered over the reduced-bass input audio signal $S_{H2}$ in an overlaying block 650, such as a summing amplifier, within a signal combining block 640, which results in the creation of a complete audio signal $S_V$ with virtual bass. Unlike in the first embodiment in FIG. 5, the audio signal $S_V$ with virtual bass and the input audio signal $S_E$ are fed directly into a mixer 645, which blends these two components according to the mixing ratio and which generates the output signal $S_A$. As before, the mixing ratio can be controlled by the control block 670. In one simple version, the control block 670 can be a manual controller.

Figure 7:
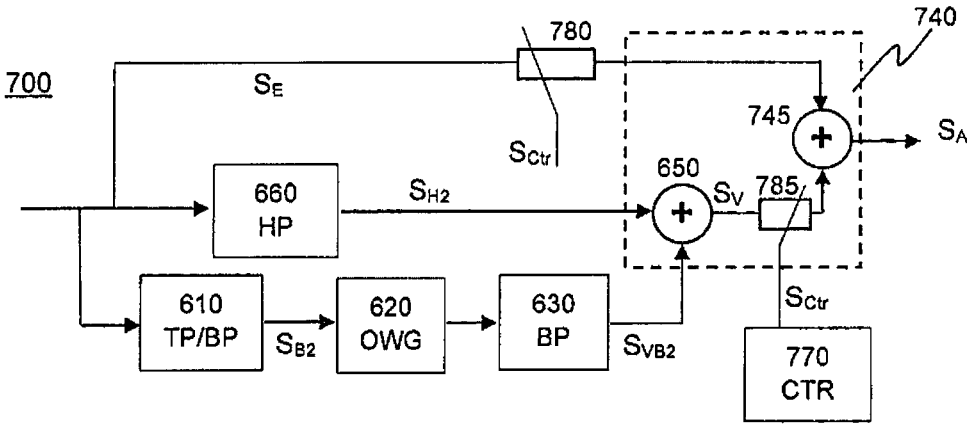
FIG. 7 shows a block diagram of an audio signal processing device according to the invention in a third embodiment.

The controllable mixer 545, 645 is schematically shown here as a potentiometer, but typically is made up of active components. Instead of a controllable mixer, the signal levels or signal amplitudes could also be controlled. In a third embodiment, which is similar to the second embodiment and which is shown in FIG. 7, the signal combining block 740 contains another overlaying block 745 or summing amplifier, and a limiter 780 reduces, or limits, the input audio signal $S_E$ according to the control parameter $S_{Ctr}$. The limiter 780 can be a part of a controllable amplifier, for example, whose amplification can be reduced in the bass range. The limiter 780 also can be a part of the signal combining block 740. A second limiter 785 boosts the virtual bass component accordingly, also depending on the control signal $S_{Ctr}$. The more the input audio signal $S_E$ is reduced, the more the virtual bass component is amplified, and vice versa. The remaining blocks are equivalent to those in the second embodiment in FIG. 6. Thus, the third embodiment essentially is equivalent to the second, wherein the mixer 645 is replaced with an overlaying block 745, or summing amplifier, and two limiters 780 and 785.

Figure 8:
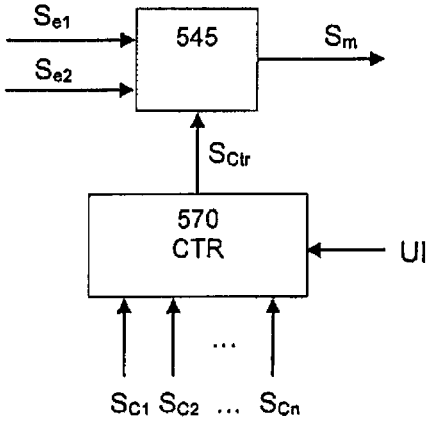
FIG. 8 shows the signal-combining block, the control block and its control values.

FIG. 8 shows the controllable mixer 545 of the signal combining block 540 and the control block 570 of the first embodiment. However, the following explanations also apply to the mixer 645 or mixer 745 and limiter 780, 785 of the signal combining blocks 640, 740 and to the control blocks 670, 770 in the second and third embodiment. In the first embodiment, the signals $S_{VB1}$ and $S_{B1}$ are applied to the inputs $S_{c1}$, $S_{c2}$ of the mixer 545, and the mixed signal $S_{MB1}$ is available at the output Sm. In the second and third embodiment, the signals $S_E$ and $S_V$ are applied to the inputs Se1, $S_{e2}$ of the mixer 645 or the limiters 780, 785, and the mixed signal $S_A$ is available at the output Sm. The control block 570 can contain a processor, for example, which can determine one or more of the aforementioned parameters. For this purpose, it receives input values $S_{C1}, \ldots, S_{Cn}$, as described above. The control block 570 also can be connected to an operating mode selector switch UI to give control to a user. The operating mode selector switch UI can be designed as a mechanic switch, for example, but can also be designed as a graphic user interface of an electronic control device.

The control block 570 generates control signals SCtr according to the input values $S_{C1}, \ldots, S_{Cn}$ and an operating mode adjusted with the operating mode selector switch UI, which control signals are used to control the mixer 545, 645, 745 within the signal combining block 540, 640, 740 to generate a corresponding mixing ratio. The input values $S_{C1}, \ldots, S_{Cn}$ can be a level or an amplitude of a (partial) signal, for example, a spectrum, a measured temperature value, a measured calorimetric value, a time of day or a clock signal. The control block 570 can combine these input values with each other to generate the control signal $S_{Ctr}$. A signal level analysis can be performed, for example, which can be used as a basis for a forecast regarding the future temperatures of the power amplifier, the power supply and/or the loudspeaker. Depending on this, a limiter can be activated, as in the third embodiment, which limiter at least reduces the bass component of the input audio signal $S_E$ and replaces it with virtual bass.

In one embodiment, it is basically possible to continuously vary the blend between "real" and "virtual" bass, by continuously changing the mixing ratio M from a minimum value (e.g., "0%") to a maximum value (e.g., "100%"). In this context, minimum value and maximum value does not necessarily have to mean that a respective component (virtual bass or original bass) is eliminated completely. For example, minimum value also can mean that 10% virtual bass are added to the original bass, or that virtual bass is only added when the original bass is reduced by at least a certain value, e.g., by 10%. In principle, it also is possible to mix in additional virtual bass regardless of the operating mode. The mixing or overlaying makes it possible to optimally use the advantages of both systems. Thus, it is possible to optimize the listening experience with regards to reproducible bass under consideration of various influences such as level, perception of sound, spatial situation, temperature or time of day.

The invention can be implemented as a separate device for processing audio signals. But it also can be integrated into another device such as into an amplifier, a soundbar, a subwoofer or a mixing console.

The invention claimed is:

1. A method for processing audio of an input audio signal, comprising:

generating harmonics of a bass component of the input audio signal;

generating a reduced-bass input audio signal from the input audio signal by reducing an amplitude of the bass component for which the harmonics were generated to a residual bass amplitude; and adding the generated harmonics to the reduced-bass input audio signal, whereby an output signal having an output bass component is created;

wherein:

in a first operating mode, no generated harmonics are contained in the output signal and the output bass component is equivalent to the bass component of the input audio signal;

in a second operating mode, the generated harmonics are contained in the output signal with a maximum harmonics amplitude and the bass component of the input audio signal is contained in the output signal with only the residual bass amplitude; and in a third operating mode, a blend of the generated harmonics and the bass component of the input audio signal is contained in the output signal, wherein the output bass component has an amplitude which is lower than that in the first operating mode and higher than that in the second operating mode, and wherein the generated harmonics in the output signal have an amplitude which is higher than those in the first operating mode and lower than those in the second operating mode.

2. The method according to claim 1, wherein the blend, in the third operating mode, is created by mixing and is performed according to a mixing ratio, and wherein the mixing ratio is variable and is determined automatically.

3. The method according to claim 2, wherein the amplitude of the bass component of the input audio signal is reduced according to the mixing ratio; and the amplitude of the added harmonics is adjusted according to the mixing ratio, wherein the amplitude of the added harmonics is increased as the amplitude of the output bass component is decreased.

4. The method according to claim 2, wherein the mixing ratio is determined automatically based on at least one parameter, wherein the at least one parameter is obtained by a determination of time, a temperature measurement, a power measurement of at least the bass component of the input audio signal, or an operating mode selector switch.

5. The method according to claim 2, wherein the mixing ratio is determined automatically based on a combination of at least two of the following: a determination of time, a temperature measurement, a power measurement of at least the bass component of the input audio signal, and an operating mode selector switch.

6. The method according to claim 4, wherein the mixing ratio is determined automatically based on a combination of a time of day, a power level of at least the bass component of the input audio signal and a position of an operating mode selector switch.

7. The method according to claim 6, wherein the power of at least the bass component of the input audio signal is measured, wherein the measured power is used to estimate a temperature of a device for executing the method or of a loudspeaker, and wherein the estimated temperature is used as a parameter in the determination of the mixing ratio.

8. The method according to claim 2, wherein the mixing ratio can assume infinitely variable values between a defined minimum and a defined maximum.

9. The method according to claim 1, wherein a bandwidth of the bass component affected by the reducing and mixing is variable.

10. An apparatus for processing audio of an input audio signal comprising:

a harmonics generator for generating harmonics of a bass component of the input audio signal;

a bass level controller for generating a reduced-bass input audio signal by reducing an amplitude of the bass component, for which the harmonics were generated, to a residual bass amplitude;

a signal combining block for adding the generated harmonics to the reduced-bass input audio signal, whereby an output signal having an output bass component is created; and a control unit for controlling the signal combining block;

wherein the signal combining block has is configured to operate in at least three operating modes, of which one is selected by the control unit, wherein in a first operating mode, no harmonics generated by the harmonics generator are contained in the output signal and the output bass component is equivalent to the bass component of the input audio signal;

in a second operating mode, the harmonics generated by the harmonics generator are contained in the output signal with a maximum harmonics amplitude and the bass component of the input audio signal is contained in the output signal with only the residual bass amplitude; and in a third operating mode, a blend of harmonics generated by the harmonics generator and the bass component of the input audio signal is contained in the output signal, wherein the output bass component has an amplitude which is lower than that in the first operating mode and higher than that in the second operating mode, and wherein the generated harmonics in the output signal have an amplitude which is higher than those in the first operating mode and lower than those in the second operating mode.

11. The apparatus according to claim 10, wherein in the third operating mode the blend is created by mixing according to a mixing ratio, wherein the mixing ratio is variable, wherein the amplitude of the bass component of the input audio signal is reduced according to the mixing ratio; and wherein the amplitude of the added harmonics is adjusted according to the mixing ratio, and wherein the amplitude of the added harmonics is increased as the amplitude of the output bass component is decreased.

12. The apparatus according to claim 10, wherein the signal combining block contains a mixer for mixing the generated harmonics with the bass component the input audio signal, wherein a resulting bass signal is created, and further contains an overlaying block for layering the resulting bass signal and the reduced-bass input audio signal.

13. The apparatus according to claim 10, wherein the signal combining block contains an overlaying block for layering the generated harmonics with the reduced-bass input audio signal, wherein an audio signal with virtual bass is created, and contains a mixer for mixing the input audio signal with the audio signal with virtual bass.

14. The apparatus according to claim 10, wherein the control unit automatically determines amplitudes of the generated harmonics and the output bass component from at least one parameter in the third operating mode, and wherein the at least one parameter is obtained by a determination of time, a temperature measurement, or a power measurement of the input audio signal or the bass component.

15. A soundbar, subwoofer or mixing console having an apparatus according to claim 10.

* * * * *